US007311469B2

(12) United States Patent
Pollack et al.

(10) Patent No.: US 7,311,469 B2
(45) Date of Patent: Dec. 25, 2007

(54) FLOATING LOWERING AND LIFTING DEVICE

(75) Inventors: Jack Pollack, Houston, TX (US); Hein Wille, Eze (FR)

(73) Assignee: Single Buoy Moorings Inc., Marly (CH)

( * ) Notice: Subject to any disclaimer, the term of this patent is extended or adjusted under 35 U.S.C. 154(b) by 64 days.

(21) Appl. No.: 10/522,813

(22) PCT Filed: Jul. 21, 2003

(86) PCT No.: PCT/EP03/08066

§ 371 (c)(1),
(2), (4) Date: Jan. 31, 2005

(87) PCT Pub. No.: WO2004/012990

PCT Pub. Date: Feb. 12, 2004

(65) Prior Publication Data

US 2006/0042534 A1 Mar. 2, 2006

(30) Foreign Application Priority Data

Jul. 30, 2002 (EP) ..... 02078127

(51) Int. Cl.
*B63C 11/00* (2006.01)

(52) U.S. Cl. ..... 405/193; 405/191; 405/205; 405/206; 405/203

(58) Field of Classification Search ..... 405/203–206, 405/209, 190–193
See application file for complete search history.

(56) References Cited

U.S. PATENT DOCUMENTS

| | | | | |
|---|---|---|---|---|
| 3,589,133 | A * | 6/1971 | Lowd et al. | 405/204 |
| 3,633,369 | A | 1/1972 | Lawrence | |
| 3,713,411 | A * | 1/1973 | Bordessoule et al. | 114/333 |
| 4,683,832 | A | 8/1987 | Dysarz | |
| 5,097,786 | A | 3/1992 | Sheffield | |
| 6,082,947 | A | 7/2000 | Adamson | |
| 6,588,985 | B1 * | 7/2003 | Bernard | 405/191 |
| 6,772,705 | B2 * | 8/2004 | Leonard et al. | 114/333 |
| 6,935,262 | B2 * | 8/2005 | Roodenburg et al. | 114/258 |

* cited by examiner

*Primary Examiner*—Frederick L. Lagman
(74) *Attorney, Agent, or Firm*—Young & Thompson

(57) ABSTRACT

A floating lowering and lifting device (1) includes a floating structure (2) and a lifting unit (3) lowerable from the floating structure (2) towards the sea bed, the lifting unit (3) having a chamber (5) with at least one gas-inlet opening (9) in its wall (27) and an equalization opening (23, 25) in its wall (27), a gas supply (13) being connected to the gas inlet opening (9) The device includes a control element (15) connected to the gas supply (13) for controlling a gas supply rate to the chamber (5), wherein the chamber (5) includes a releasable coupling member (7) for releasably attaching to a load (8).

19 Claims, 4 Drawing Sheets

FLOATING LOWERING AND LIFTING DEVICE

The invention relates to a floating lowering and lifting device comprising a floating structure and a lifting unit lowerable from the floating structure towards the sea bed.

It is known to lower large weight loads (templates for example) onto the seabed with cables from a floating barge. A problem with prior art systems which use a tensioned connection between the weight and the floating vessel, like a cable, to take the weight, is that due to the movements of the floating vessel snap tensions will be introduced in the cable.

As very long cables and very large weights are used, these snap tensions can break the cable (this problem is solved by the construction according to U.S. Pat. No. 5,190,107, a heave compensating support system for positioning a sub sea work package). In very deep waters and with very large weights, the diameter and the weight of the cables are becoming to big to handle: for example the weight of a 6 inch cable of 1000 m is about 100 tons and the diameter of the cable will be to big to handle.

It is possible to use devices to lower packages onto the seabed with the help of pressurized closed buoyancy cans. The cans must be so constructed to withstand the water pressure at seabed level; every 10 m water depth will add 1 bar. Such a system is shown in the above U.S. Pat. No. 5,190,107.

Very deep waters have relative high pressures at seabed level. This, combined with the relatively large weight to be transported makes the use of closed buoyant cans or modules very expensive due to the size of such a buoyancy module and the construction needed to avoid collapsing of the buoyancy module.

It is therefore an object of the present invention to provide a lowering and lifting device for lifting our lowering relatively heavy weights in deep water.

It is a further object of the present invention to provide a lowering and lifting device which can be raised and lowered in a controlled manner using a simple and reliable control system.

Thereto, the lowering and lifting device according to present invention comprises a chamber with at least one gas inlet opening in its wall and an equalisation opening in its wall, a gas supply means being connected to the gas inlet opening, the device comprising a control means connected to the gas supply means for controlling a gas supply rate to the chamber, wherein the chamber comprises a releasable coupling member for releasably attaching to a load.

The device according to the present invention can be used for lowering to the seabed of heavy loads (500 tons or more) in relative deep water (for example 1000 m). The lifting unit can be connected to and disconnected from the load and includes a large, "soft volume" structure which has an opening to the environment in the lower part and which can be filled with a gas above its opening to add buoyancy. Due to the fact that the chamber of the lifting unit is not a closed pressure module, the construction can be relative simple and can be constructed at low costs as there will be no pressure differences between the inside and the outside of the module. The gas (air) inside the open chamber will compensate the weight of the chamber and the weight of the load to be transported to or from the seabed, at any position during the lowering and raising. Adding gas will ensure a controlled lowering/deployment of the combination of the device and the connected package, for example creating an uplift of 490-500 tons at a load of 500 tons. During the way down, gas (such as for instance air or Nitrogen) needs to be added into the chamber as the gas trapped in it the will be reduced in volume due to the increase of the external water pressure. The combination of lifting device and load sinks due to the resultant small negative buoyancy of the combination, which can be controlled, from the floating barge by a vent system on the module. After depositing the load on the seabed, gas is removed from the chamber via a gas release mechanism to maintain neutral buoyancy or a small positive buoyancy after disconnecting of the load such that the lifting unit can be retrieved at the water surface.

The control means connected to the gas supply means can comprise for instance an electrically or mechanically controlled valve in a gas supply duct to the chamber, or a remote control valve on the chamber which is actuated by means of a sonar system or radio transmitter or any equivalent means such as fibre optics or any other signal carriers.

During operation, the gas inlet opening is during use situated higher along a longitudinal height of the lifting unit than the equalisation opening. Gas introduced into the chamber will accumulate at the top whereas pressure equalisation with the surroundings takes place through the lower equalisation opening.

The gas supply means may, according to one embodiment, be placed on the floating structure, a fluid supply duct connecting the gas supply means to the chamber. The fluid supply duct may be a flexible duct can be connected to a container with compressed gas or a compressor supplying gas to the chamber with an over pressure. The control means may comprise a valve connected to the supply duct, which can be actuated from on board the floating structure or may be formed of a power control operatively associated with the compressor to regulate the compressor output, or combinations thereof.

In another alternative embodiment, the gas supply means comprise a container which is connected to the chamber via a controllable valve, the container comprising compressed gas and being lowerable with the chamber, the control means being connected to the valve for controlling the gas supply to the chamber. The control means may comprise a cable connected to a supply setting unit on board of the vessel on one side and connected to the valve which is lowered with the chamber on the other side. The cable may comprise electrical, optical or other means of signal transmission. Alternatively, an acoustic receiver may be comprised on the valve being lowered with the chamber whereas a transmitter is placed on board of the vessel. Again, a radio transmitter may be comprised on board of the vessel whereas the receiver is connected to the valve of the container connected to the chamber for opening or closing said valve.

Even though the chamber has a controlled buoyancy during raising and/or lowering of the load, the lifting unit may be connected to the vessel via a guide cable for assisting in station keeping of the lifting unit and for preventing drift or positional change with respect to the vessel and for retrieval of the lifting unit on board of the vessel.

For positional adjustment, the chamber may be provided with one or more thrusters powered via the control line. For heave compensation an tensional equalisation in the guide cable and/or control line, the guide line or control line may be connected to an arm on the floating structure, the arm comprising a sheeve and a counter weight attached to the sheeve via an arm, the sheeve being suspended from said arm. This way a heave compensating adjustment is achieved. For controlled raising or lowering a gas release mechanism is connected to a control means adapted to be opened upon detaching the releasable coupling member from the load. In this way, the buoyancy of the unit can be reduced prior to detaching of the load and the lifting unit will not be accelerated upwards by its reduced mass, but can be raised to the surface in a controlled manner.

Some embodiments of a floating lowering and lifting device according to the present invention, will, by way of example, be explained in detail with reference to the accompanying drawings. In the drawings.

Figure 1:
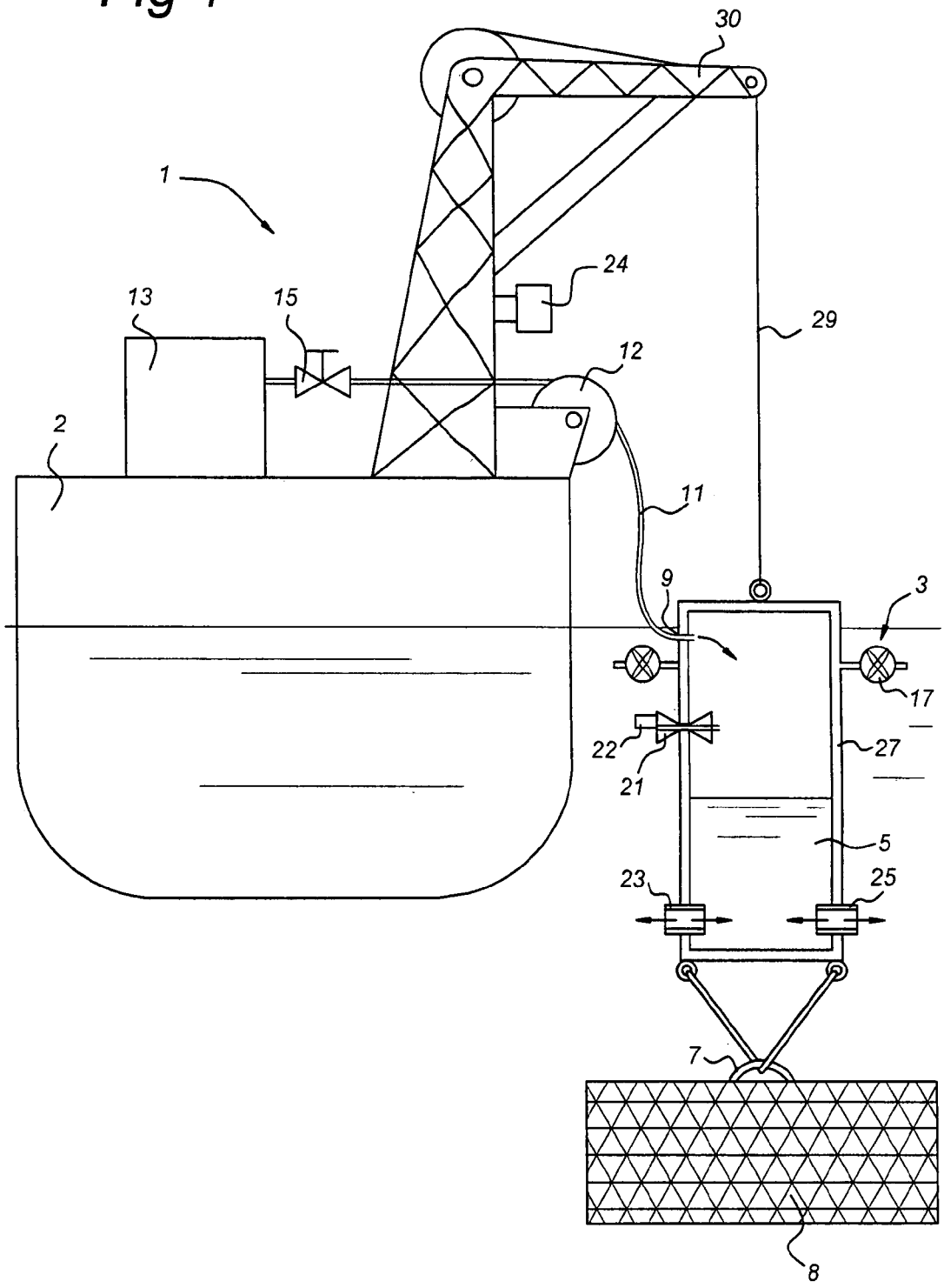
FIG. 1 shows a schematic view of the first embodiment which the chamber of the lifting device is supplied with gas from floating structure.

FIG. 1 shows a floating lowering and lifting device 1 comprising a vessel or barge 2 and a lifting unit 3. Lifting unit 3 comprises a chamber 5 provided with a releasable coupling member 7 carrying a load 8 that is to be raised from or lowered to the seabed. The chamber 5 comprises gas inlet opening 9 which is connected to a gas supply hose 11. The air hose 11 may be wound on an air hose reel 12 and may be attached to gas supply means 13 which may formed of a compressor or which may be a storage tank comprising gas or compressed gas. A control valve 15 may be included in the air hose 11 for increasing or decreasing the gas supply rate from the tank of compressed air 13. The chamber 5 comprises furthermore a thruster 17 for positioning of the chamber and a controllable gas release valve 21, which may comprise a sonar detector 22 for communicating with sonar transmitter 24 for opening or closing of the valve 21. Sonar transmitter 24 may be operated from the vessel 2. Furthermore, the chamber 5 comprises equalisation openings 23, 25 in the lower wall 27 of the chamber 5 for equalising the pressure inside the chamber 5 with the ambient pressure. By controlling the valve 15, the gas supply rate to the chamber 5 is adjusted such as to lower the load 8 in a controlled manner at the same time the air hose is wound from the reel 12. For positional purposes and for retrieval of the chamber 5 onto the vessel, the chamber 5 is connected to a guide cable 29 that is connected to a crane 30 on the vessel.

Figure 2:
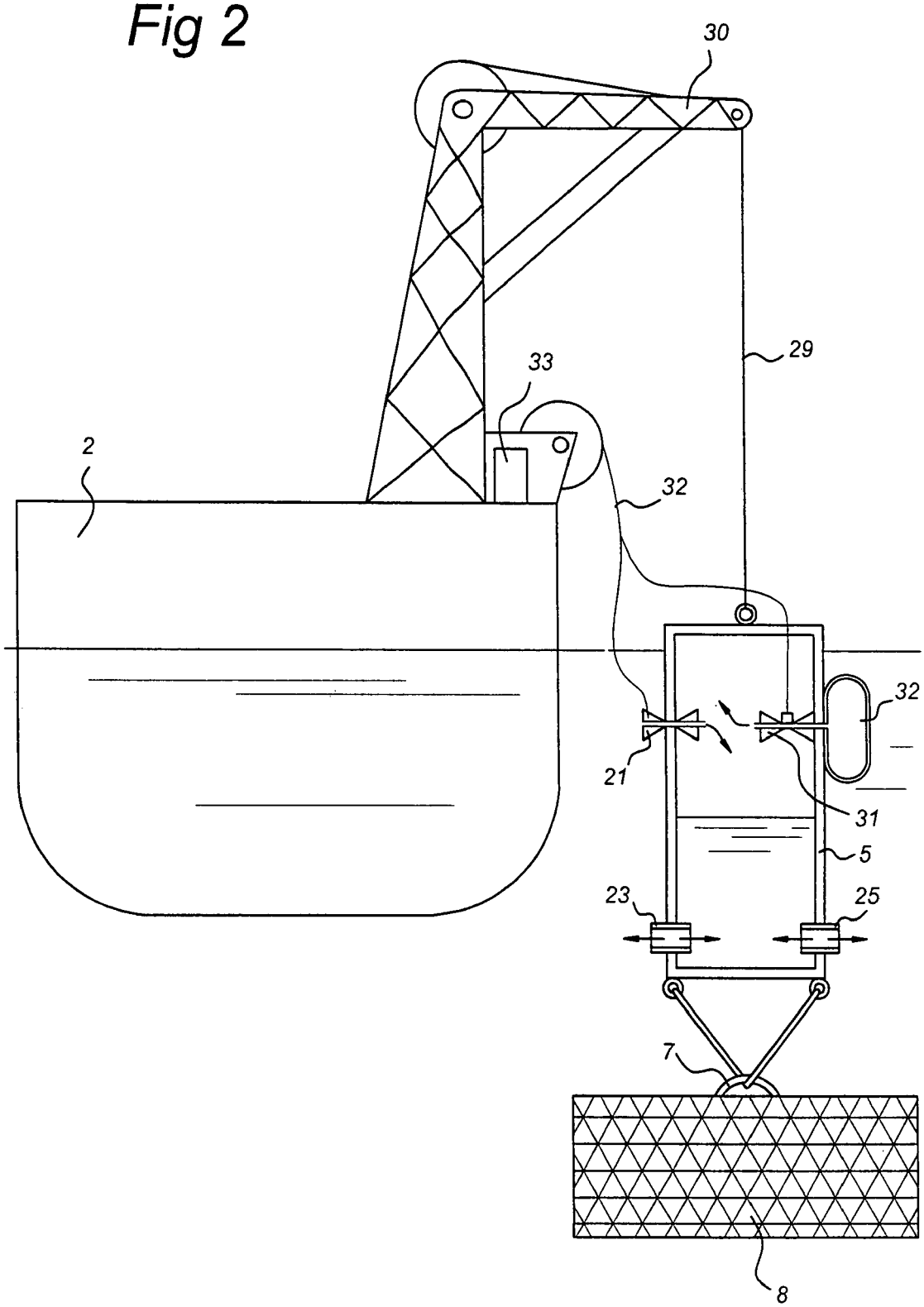
FIG. 2 is an embodiment in which the chamber of the lifting device is provided with a compressed gas source connected to the chamber.

FIG. 2 shows an embodiment in which tank 32 comprising compressed nitrogen is attached to the chamber 5. Compressed nitrogen can be entered into chamber 5 via a controllable valve 31 which is connected to electric signal control cable 32, operated from onboard of the vessel 2. A release valve 21 which can be electrically controlled is also connected via cable 32 to a control unit 33 on board of the vessel 2. Instead of via a cable 32, the valves 21, 31 may be operated via a radiographic control or via sonar or even via remote operated vehicle (ROV) which lowered together with the chamber 5 and which is operated from a control unit on board of the vessel 2.

Figure 3:
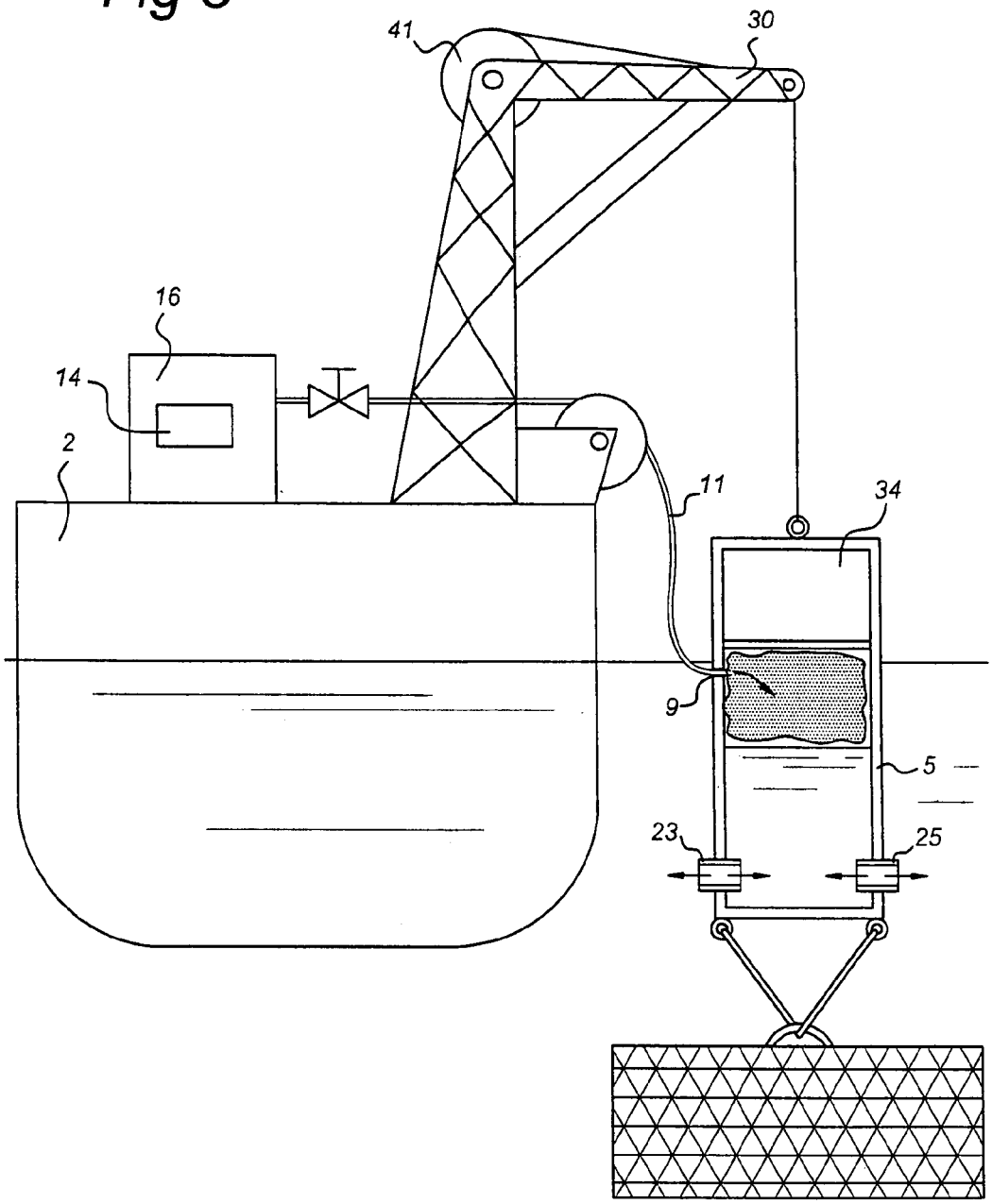
FIG. 3 is an embodiment which a closed volume filled with foam or gas is comprised in the device.

In the embodiment of FIG. 3 the chamber 5 comprises a closed volume 34 with permanent buoyancy comprising air or foam. The amount of air or foam in the enclosed space 34 may be just sufficient for providing a neutral buoyancy of the chamber 5 when the load has been deposited on the seabed.

Once the load has been deposited on the seabed, the gas in the chamber 5 that was compensating for the weight of the load 8 must be ventilated when the seabed will take the weight of the load upon lowering of the load 8 and pressural transmission of its weight onto the seabed, the release valve 21 (see FIG. 2) is operated to gradually release gas from the chamber 5 to prevent the chamber 5 from rocketing up to sea level. During the upwards trajectory gas is released via gas release valve 21 in a controlled manner for a controlled lift. Upon lowering of the chamber 5, gas is introduced into the chamber 5 in a controlled manner via valve 15 or 31 to compensate for the volume reduction of the gas by increased compression with increasing water depth. For this purpose the valve 15 and/or the compressor 16 on board of the vessel 2 may be operated in a way which is controlled by the water depth of the chamber 5.

The air hose 11 can be a relatively small diameter flexible tube. The guide cable 29 of the floating barge 2 can be of relatively small dimensions as it does not need to take the weight of the whole chamber 5 and the load 8, as the combined chamber 5 and load 8 are maintained generally at neutral buoyancy. The function of the guide cable 21 is to guide or to keep the track of the device 3 and the load 8 and to take up a limited amount of weight (for example the cable is able to take 10 tons at a combined weight of load 8 and chamber 5 of for instance 500 tons). Together with the air hose 11 an umbilical may be connected to the chamber 5 for operating thruster 17 and/or for controlling the air release valve 21 in FIG. 1.

In the compressor 16 in FIG. 3, a power control 14 is present for relating the air supply to chamber 5 in dependence of the water depth.

Figure 4:
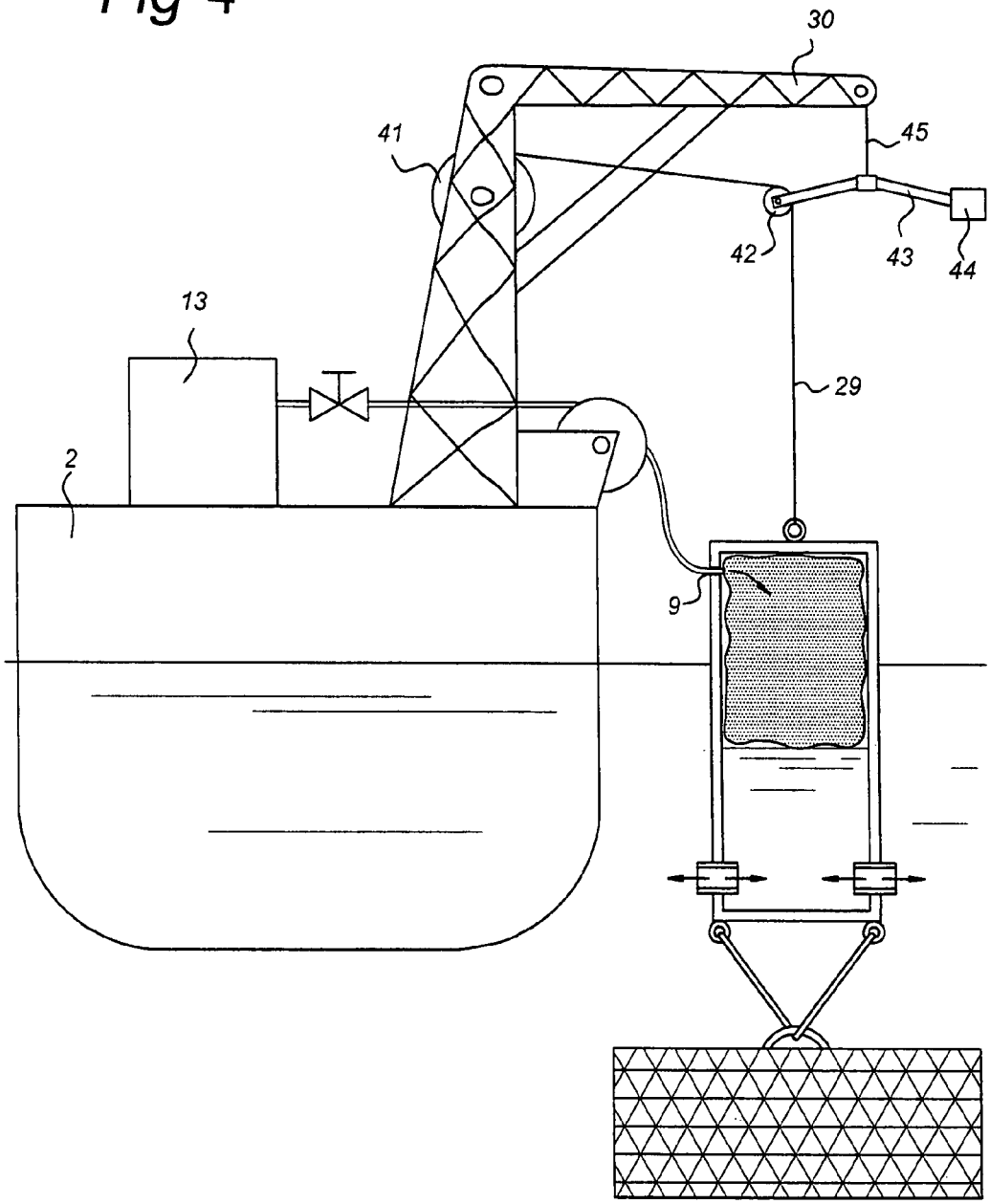
FIG. 4 is an embodiment comprising a heave and roll compensating mechanism.

Finally in FIG. 4, it is shown that the guide cable 29 is connected to a sheeve 42 at the end of an arm 43. At the second end of the arm 43 a counter weight 44 is provided. The arm 43 is near its midpoint connected to a cable 45 attached to crane 30. The guide cable 29 is wound on a winch 41. By the arm 43, a heave/roll compensating device is provided which prevents large tensioned loading in the guide cable 29 upon heave-induced motions and roll of the vessel 2.

The invention claimed is:

1. Floating lowering and lifting device (1) comprising a floating structure (2) and a lifting unit (3) lowerable from the floating structure (2) towards the sea bed, the lifting unit (3) having a chamber (5) with a least one gas-inlet opening (9) in its wall and a gas supply means (13,32) connected to the gas-inlet opening (9), the device (1) comprising a control element (14,15) for controlling a gas supply rate to the chamber (5), the chamber comprising a releasable coupling member (7) for attaching to a load, characterized in that, the lifting unit (3) is attached to the floating structure (2) in a non-rigid manner, the chamber (5) comprising at least one equalization opening (23, 25) being fluid communication with the environment outside of the chamber, the control element (14,15) being adapted to supply gas to the chamber for compensating gas volume loss at increasing depth of the lifting unit (3) below sea level and to release air from the chamber after depositing a load onto the sea bed.

2. Floating lowering and lifting device (1) according to claim 1, the gas inlet opening (9) during use being situated higher up along a longitudinal height of the lifting unit (3) than the equalization opening (23,25).

3. Floating lowering and lifting device (1) according to claim 1, wherein the gas supply elements (13) are placed on the floating structure (2), a fluid supply duct (11) connecting the gas supply elements (13) to the chamber (5).

4. Floating lowering and lifting device (1) according to claim 2, the gas inlet opening (9) during use being situated higher up along a longitudinal height of the lifting unit (3) than the equalization opening (23,25).

5. Floating lowering and lifting device (1) according to claim 2, wherein the gas supply means (13) comprises a container with a compressed gas, the control element (15) comprising a valve connected to the fluid supply duct (11), or a compressor (16), the control means comprising a power control (14) operatively associated with the compressor (16).

6. Floating lowering and lifting device (1) according to claim 1, wherein the gas supply elements comprise a container (32) connected to the chamber via a controllable valve (31), the container comprising a compressed gas and being lowerable with the chamber, the control elements (33) being connected to the valve (31) for controlling the gas supply to the chamber (5).

7. Floating lowering and lifting device (1) according to claim 2, wherein the gas supply elements comprise a container (32) connected to the chamber via a controllable valve (31), the container comprising a compressed gas and being lowerable with the chamber, the control elements (33) being connected to the valve (31) for controlling the gas supply to the chamber (5).

8. Floating lowering and lifting device (1) according to claim 1, wherein the chamber (5) is suspended from the floating structure (2) via a guide cable (29).

9. Floating lowering and lifting device (1) according to claim 1, the chamber (5) comprising ac least one thruster (17) powered via the control line.

10. Floating lowering and lifting device (1) according to claim 1, wherein the chamber (5) comprises a closed compartment (34).

11. Floating lowering and lifting device (1) according to claim 1, wherein the guide cable (29) or control line is connected to a sheave at one end of an arm (43), which is suspended from the floating structure (2), a counterweight (44) attached to an other end of the arm (43).

12. Floating lowering and lifting device (11) according to claim 1, having a gas release mechanism (21) connected to a control means which is adapted to open the gas release mechanism after placing the load on the sea bed, prior to detaching the releasable coupling member (7).

13. Method of raising and lowering an object (8) from the seabed comprising the steps of:

attaching a load (8) to the lifting unit (3) according to claim 1;

adding or releasing a gas into or from the chamber (5) in dependence of the water depth while maintaining an open connection of the chamber with the sea via the equalization opening (23,25).

14. Method according to claim 13, wherein upon depositing the load (8) onto the seabed gas is released from the chamber (5) to maintain a substantially predetermined buoyancy when the weight of the load is transferred from the lifting unit to the seabed.

15. Floating lowering and lifting device according to claim 1, wherein the lifting unit (3) is attached to the floating structure (2) by an elongated member that is flexible along its length.

16. Floating lowering and lifting device according to claim 15, wherein said elongated member is a cable wound on and unwound from a reel.

17. Floating lowering and lifting device according to claim 1, said control element being connected to said lifting unit by a flexible air supply line.

18. Floating lowering and lifting device according to claim 17, and an air hose reel (12) on which said flexible air supply line is wound.

19. Floating lowering and lifting device according to claim 1, wherein said chamber (5) is in continuous fluid communication with the environment outside the chamber.

* * * * *